US011510467B2

(12) United States Patent
Chiang

(10) Patent No.: US 11,510,467 B2
(45) Date of Patent: Nov. 29, 2022

(54) LUGGAGE

(71) Applicant: C & C LUGGAGE MANUFACTURING CO., LTD., Zhongshan (CN)

(72) Inventor: Hsi-Wu Chiang, Zhongshan (CN)

(73) Assignee: C & C LUGGAGE MANUFACTURING CO., LTD., Zhongshan (CN)

( * ) Notice: Subject to any disclaimer, the term of this patent is extended or adjusted under 35 U.S.C. 154(b) by 387 days.

(21) Appl. No.: 16/556,959

(22) Filed: Aug. 30, 2019

(65) Prior Publication Data

US 2020/0069018 A1 Mar. 5, 2020

(30) Foreign Application Priority Data

Sep. 5, 2018 (TW) ..... 107131170

(51) Int. Cl.

| | |
|---|---|
| ***A45C 13/02*** | (2006.01) |
| ***A45C 5/06*** | (2006.01) |
| ***A45C 13/10*** | (2006.01) |
| ***A45C 5/03*** | (2006.01) |

(52) U.S. Cl.

CPC ..... *A45C 13/02* (2013.01); *A45C 5/03* (2013.01); *A45C 5/06* (2013.01); *A45C 13/103* (2013.01)

(58) Field of Classification Search

CPC .. A45C 13/02; A45C 5/03; A45C 5/06; A45C 13/103

See application file for complete search history.

(56) References Cited

U.S. PATENT DOCUMENTS

| | | | | |
|---|---|---|---|---|
| 4,830,154 | A * | 5/1989 | Gerch | A45C 3/00 190/103 |
| 5,054,589 | A * | 10/1991 | Bornes | A45C 13/02 190/18 A |
| 8,453,813 | B2 * | 6/2013 | Lai | A45C 13/02 190/110 |
| 2003/0209396 | A1 * | 11/2003 | Bernbaun | A45C 7/0054 190/18 A |
| 2004/0188205 | A1 * | 9/2004 | Badaan | A45C 13/04 190/124 |
| 2014/0166415 | A1 * | 6/2014 | Lai | A45C 5/06 190/111 |
| 2019/0298026 | A1 * | 10/2019 | Lai | A45C 7/0027 |

FOREIGN PATENT DOCUMENTS

| | | |
|---|---|---|
| TW | M408273 U | 8/2011 |
| TW | M453408 U | 5/2013 |

* cited by examiner

*Primary Examiner* — Tri M Mai

(74) *Attorney, Agent, or Firm* — Muncy, Geissler, Olds & Lowe, P.C.

(57) ABSTRACT

A luggage includes a luggage main body, a partition board stitched with its bottom side to the bottom side of the luggage main body, an inner zip fastener provided between the partition board and the luggage main body so that the partition board can open or close a first storage chamber in the luggage main body, a luggage cover stitched with its bottom side to the bottom side of the luggage main body, and an outer zip fastener provided between the luggage cover and the luggage main body so that the luggage cover can open or close a second storage chamber that is defined between the luggage cover and the luggage main body.

4 Claims, 3 Drawing Sheets

LUGGAGE

BACKGROUND OF THE INVENTION

1. Field of the Invention

The present invention relates to luggage, and more particularly to such a luggage that separates storage items of different nature.

2. Description of the Related Art

Common luggage simply has one single storage chamber for storing different items. So, whether it's work items (such as laptops) or personal belongings (such as changing clothes), they are all mixed together. This manner causes a lot of inconvenience to the user when picking up the items. In the event that there is an urgent need to find a specific item so that the entire luggage is opened, it is prone to the embarrassing situation in which the private item is exposed. Even if the luggage is provided with an indefinite number of sub-bags on the structure, it may be difficult to use because of the size or quantity. Therefore, the luggage with one single storage chamber is necessary for improvement.

SUMMARY OF THE INVENTION

The present invention has been accomplished under the circumstances in view. It is the main object of the present to provide a luggage that separates items of different nature so that the user can select and pick up the items they need.

To achieve this object of the present invention, a luggage is provided to comprise a luggage main body, a partition board, an inner zip fastener, a luggage cover and an outer zip fastener. The luggage main body comprises a first storage chamber, and a rim extending around the first storage chamber. The partition board faces toward the first storage chamber of the luggage main body, having a bottom side thereof connected to a bottom side of the luggage main body. The inner zip fastener is provided on the rim of the luggage main body and the outer peripheral edge of the partition board to control opening and closing of the first storage chamber of the luggage main body. The luggage cover has the bottom side thereof connected to the bottom side of the luggage main body so that the luggage cover and the partition board define therebetween a second storage chamber. The outer zip fastener is provided on the rim of the luggage main body and the outer peripheral edge of the luggage cover to control opening and closing of the second storage chamber.

As can be seen from the above, the user can separately place items of different nature in the first storage chamber and the second storage chamber, for example, personal items (such as changing clothes) can be placed in the first storage chamber, and work items (such as notebooks, cameras, books, etc.) can be placed in the second storage chamber. The user can just open one of the abovementioned storage chambers to reach the items according to actual needs. This not only saves time in taking items, but also avoids the embarrassing situation in which private items are revealed because the user is looking for specific items for work.

Preferably, the partition board can be provided with one or more storage pockets on its one side that faces toward the luggage cover, so that the user can place small items such as batteries, memory cards, flash drives, transmission lines or power cords that may be easily dropped.

Preferably, one flexible connection member is disposed between the left side of the partition board and the left side of the luggage cover, one flexible connection member is disposed between the right side of the partition board and the right side of the luggage cover. Thus, the opening angle of the luggage cover is restricted by the two opposite flexible connection members.

Other advantages and features of the present invention will be fully understood by reference to the following specification in conjunction with the accompanying drawings, in which like reference signs denote like components of structure.

DETAILED DESCRIPTION OF THE INVENTION

Figure 1:
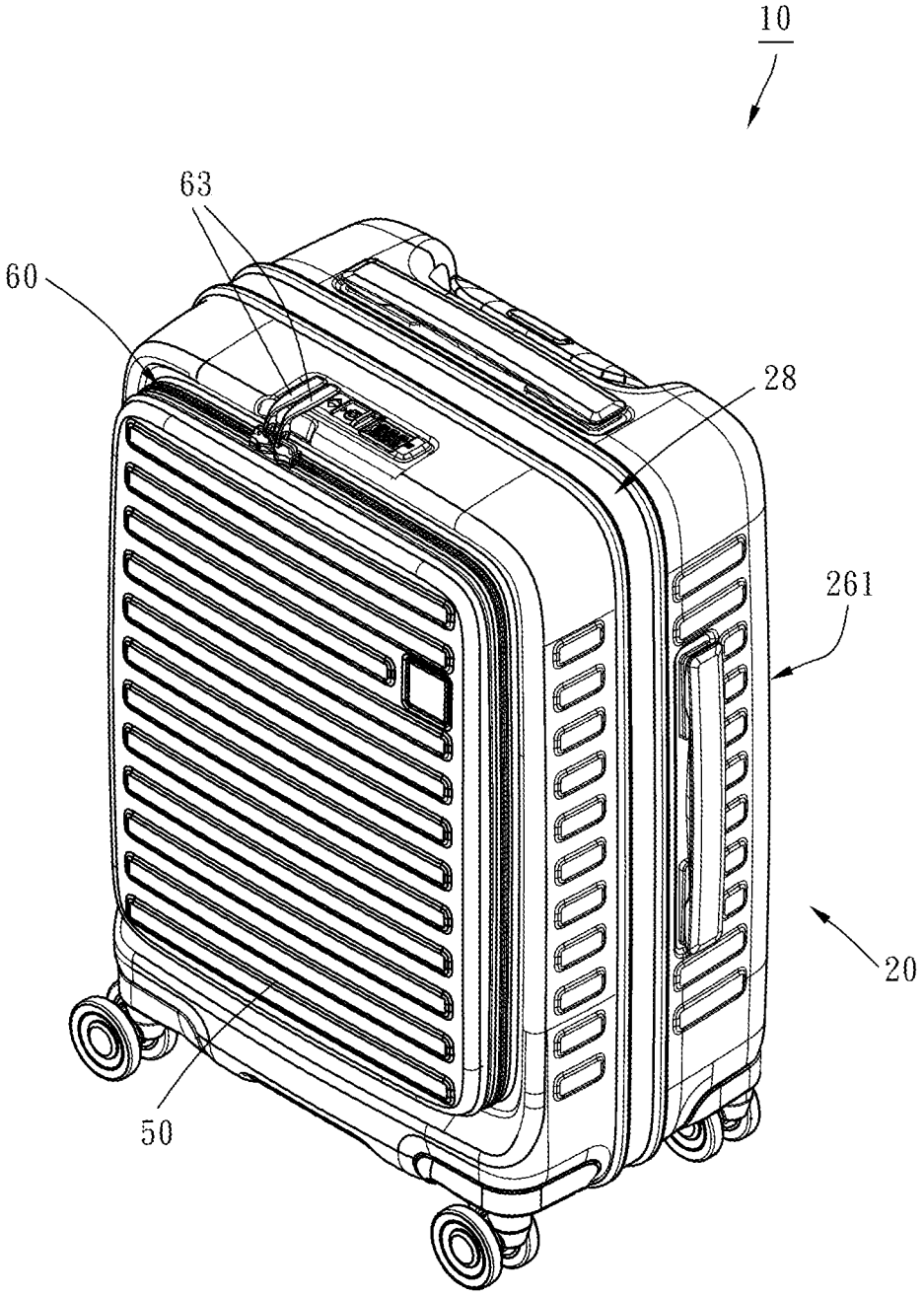
FIG. 1 is an oblique top elevational view of a luggage in accordance with the present invention.

Firstly, in the following embodiment and drawings, the same reference numerals are used to indicate similar or the same members or its structural features.

Figure 2:
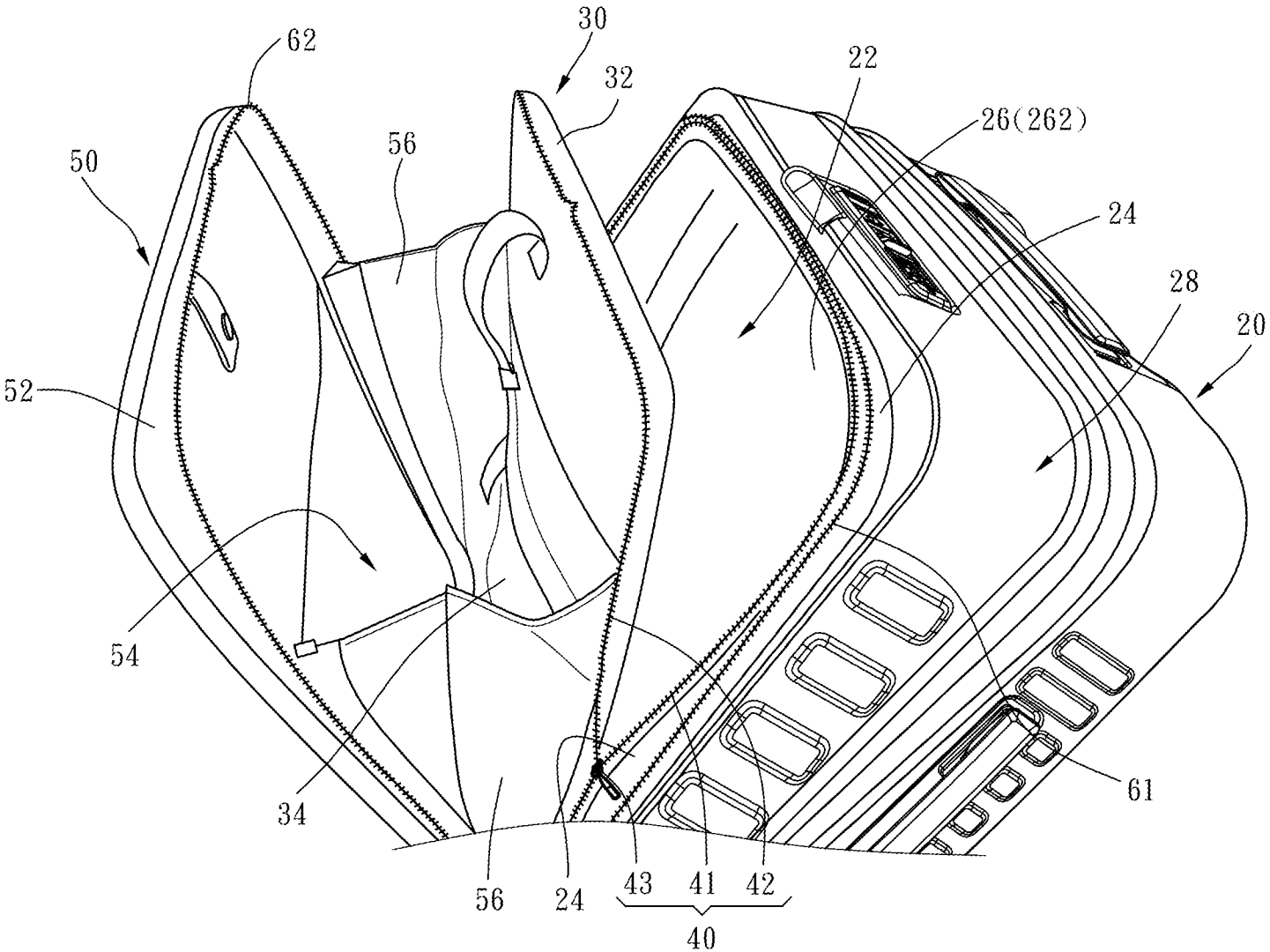
FIG. 2 is a schematic elevational view of a part of the luggage of the present invention, illustrating the first and second storage chambers that are opened.
Figure 3:
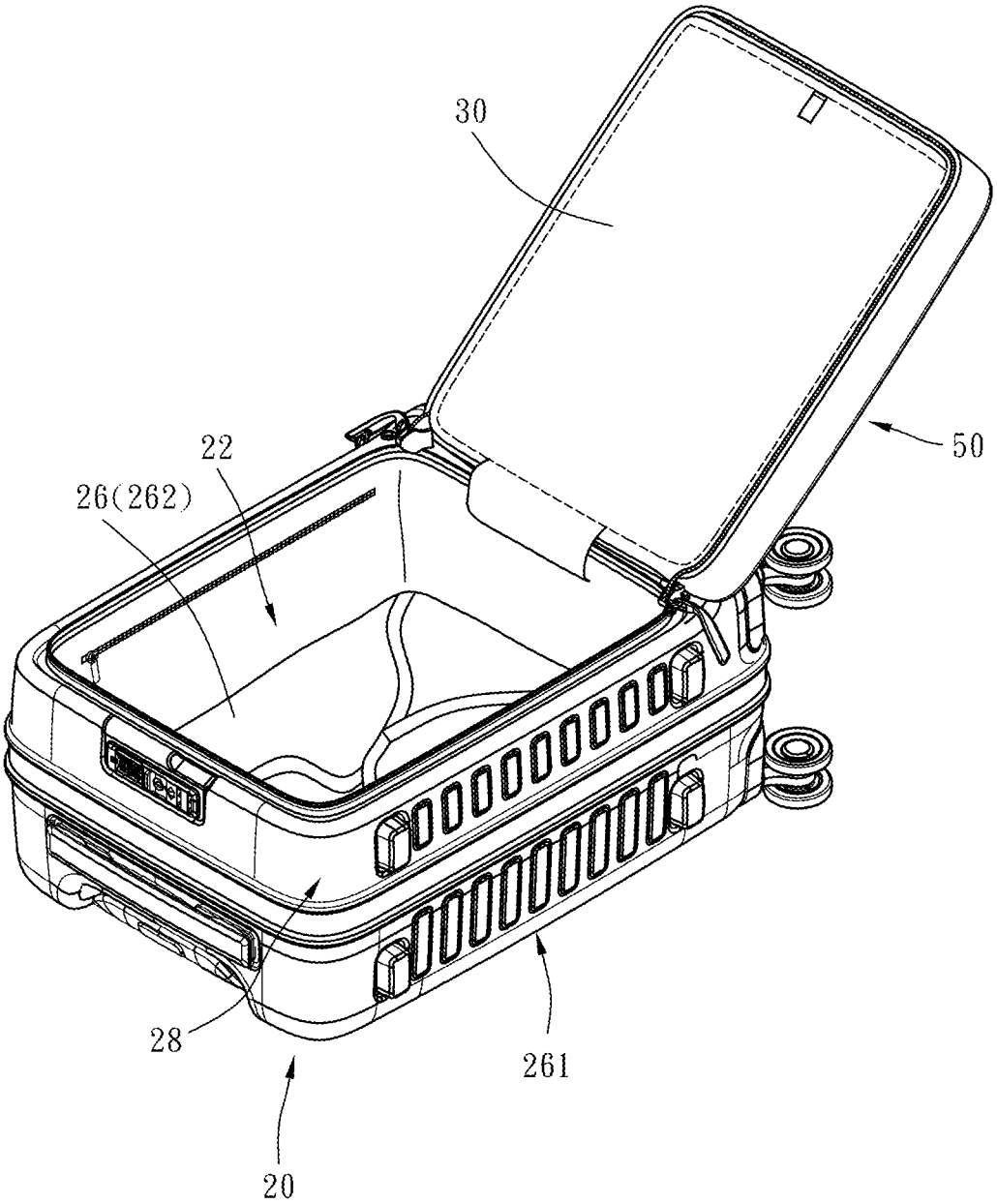
FIG. 3 is a schematic elevational view of a part of the luggage of the present invention, illustrating the first storage chambers that are opened.

Referring to FIGS. 1-3, a luggage 10 in accordance with the invention is shown. The luggage 10 comprises a luggage main body 20, a partition board 30, an inner zip fastener 40, a luggage cover 50, and an outer zip fastener 60.

The luggage main body 20 defines a first storage chamber 22 and a rim 24 extending around the first storage chamber 22. The luggage main body 20 comprises a lateral board 26 and a frame member 28. The frame member 28 surrounds and connects with a peripheral of the lateral board 26. The first storage chamber 22 is jointly defined by the lateral board 26 and the frame member 28. The rim 24 is provided on the frame member 28 and the rim 24 communicates with the first storage chamber 22. The lateral board 26 has an outer lateral surface 261 which is directed in a direction opposite to the first storage chamber 22. The outer lateral surface 261 is exposed outside the luggage 10 when the luggage 10 is closed. The lateral board 26 also has an inner lateral surface 262 which is disposed opposite to the outer lateral surface 261 and faces the first storage chamber 22.

The partition board 30 has an inner surface thereof facing toward the first storage chamber 22 of the luggage main body 20 and a bottom side thereof stitched (or connected) to a side of frame member 28 of the luggage main body 20. The partition board 30 directively covers the inner lateral surface 262.

The inner zip fastener 40 is provided on the rim 24 of the frame member 28 of the luggage main body 20 and the outer peripheral edge 32 of the partition board 30, so that the rim 24 of the luggage main body 20 and the outer peripheral edge 32 of the partition board 30 can be connected in a detachable manner. More specifically, the inner zip fastener 40 comprises a first inner set of zipper teeth 41, a second inner set of zipper teeth 42 and an inner zipper slider 43. The first inner set of zipper teeth 41 is stitched to the rim 24 of the luggage main body 20. The second inner set of zipper teeth 42 is stitched to the outer peripheral edge 32 of the partition board 30. The inner zipper slider 43 is coupled between the first inner set of zipper teeth 41 and the second inner set of zipper teeth 42. Thus, when the inner zip fastener 40 is unzipped, the partition board 30 can be opened, and the first storage chamber 22 of the luggage main body 20 is open. On the contrary, when the inner zip fastener 40 is zipped, the partition board 30 will cover the first storage chamber 22 of the luggage main body 20.

The luggage cover 50 faces toward an opposing outer surface of the partition board 30 and has a bottom side thereof stitched (or connected) to the side of the frame member of the luggage main body 20 so that the luggage cover 50 and the partition board 30 define therebetween a second storage chamber 54.

The outer zip fastener 60 is provided on the rim 24 of the frame member 28 of the luggage main body 20 and the outer peripheral edge 52 of the luggage cover 50, so that the rim 24 of the luggage main body 20 and the outer peripheral edge 52 of the luggage cover 50 are connected in a detachable manner. More specifically, the outer zip fastener 60 comprises a first outer set of zipper teeth 61, a second outer set of zipper teeth 62 and an outer zipper slider 63. The first outer set of zipper teeth 61 is stitched to the rim 24 of the luggage main body 20 to surround outside the first inner set of zipper teeth 41 of the inner zip fastener 40. The second outer set of zipper teeth 62 is stitched to the outer peripheral edge 52 of the of the luggage cover 50. The outer zipper slider 63 is coupled between the first outer set of zipper teeth 61 and the second outer set of zipper teeth 62. Thus, when the outer zip fastener 60 is unzipped, the luggage cover 50 can be opened, and the second storage chamber 54 is open. On the contrary, when the outer zip fastener 60 is zipped, the luggage cover 50 will cover the second storage chamber 54.

As can be seen from the above, the user can separately place items of different nature in the first storage chamber 22 and the second storage chamber 54, for example, personal items (such as changing clothes) can be placed in the first storage chamber 22, and work items (such as notebooks, cameras, books, etc.) can be placed in the second storage chamber 54. After that, just open one of the first storage chamber 22 or the second storage chamber 54 according to actual needs. This not only saves time in taking items, but also avoids the embarrassing situation in which private items are revealed because the user is looking for specific items for work.

On the other hand, a flexible connection member 56 is disposed between the left side of the partition board 30 and the left side of the luggage cover 50, one other flexible connection member 56 is disposed between the right side of the partition board 30 and the right side of the luggage cover 50. The opening angle of the luggage cover 50 is restricted by the two opposite flexible connection members 56, so as to prevent the items placed in the second storage chamber 54 from dropping to cause damage due to the opening angle of the luggage cover 50 being excessively large. In addition, the partition board 30 can be provided with one or more storage pockets 34 on its one side that faces toward the luggage cover 50, so that the user can place small items such as batteries, memory cards, flash drives, transmission lines or power cords that are easily dropped.

What is claimed is:

1. A luggage, comprising:

a luggage main body comprising a first storage chamber and a rim extending around said first storage chamber;

a partition board facing toward said first storage chamber of said luggage main body and having a bottom side thereof connected to a bottom side of said luggage main body;

an inner zip fastener provided on said rim of said luggage main body and an outer peripheral edge of said partition board to control opening and closing of said first storage chamber of said luggage main body;

a luggage cover having a bottom side thereof connected to the said bottom side of said luggage main body so that said luggage cover and said partition board define therebetween a second storage chamber; and an outer zip fastener provided on said rim of said luggage main body and an outer peripheral edge of said luggage cover to control opening and closing of said second storage chamber;

wherein the luggage main body comprises a lateral board and a frame member; the frame member surrounds and connects with a peripheral of the lateral board; the first storage chamber is jointly defined by the lateral board and the frame member; the rim is provided on the frame member; the rim communicates with the first storage chamber; the lateral board has an outer lateral surface which is directed in a direction opposite to the first storage chamber, and the outer lateral surface is exposed outside the luggage when the luggage is closed; the bottom side of the partition board is connected with the frame member; the bottom side of the luggage cover is connected with the frame member; the lateral board further has an inner lateral surface which is disposed opposite to the outer lateral surface and faces the first storage chamber, and the partition board directly covers the inner lateral surface;

wherein when the inner zip fastener is unzipped, the partition board is opened and the first storage chamber of the luggage main body is therefore open;

wherein the luggage main body further comprises an annular ridge; the annular ridge comprises a first annular portion and a second annular portion connecting the first annular portion; the annular ridge is connected with the frame member by the first annular portion, and the annular ridge is connected with the rim by the second annular portion; the first annular portion extends in a direction parallel to the frame member while the second annular portion extends and bends inward to a center of the first storage chamber; the rim is a single piece member and the rim directly and integrally connects the second annular portion and extends in a direction far away from the lateral board.

2. The luggage as claimed in claim 1, wherein said partition board is provided with a storage pocket on one side thereof that faces toward said luggage cover.

3. The luggage as claimed in claim 1, further comprising two opposing flexible connection members; one of said flexible connection members is disposed between a left side of said partition board and a left side of said luggage cover; the other one of said flexible connection members is disposed between an opposing right side of said partition board and an opposing right side of said luggage cover.

4. The luggage as claimed in claim 1, wherein said inner zip fastener comprises a first inner set of zipper teeth fastened to said rim of said luggage main body, a second inner set of zipper teeth fastened to said outer peripheral edge of said partition board and an inner zipper slider coupled between said first inner set of zipper teeth and said second inner set of zipper teeth; said outer zip fastener comprises a first outer set of zipper teeth fastened to said rim of said luggage main body and surrounded out of the first inner set of zipper teeth, a second outer set of zipper teeth fastened to said outer peripheral edge of said luggage cover and an outer zipper slider coupled between said first outer set of zipper teeth and said second outer set of zipper teeth.

* * * * *